US008684707B2

(12) United States Patent
Kanai et al.

(10) Patent No.: US 8,684,707 B2
(45) Date of Patent: Apr. 1, 2014

(54) PIEZOELECTRIC MICROBLOWER

(75) Inventors: Shungo Kanai, Nagaokakyo (JP); Gaku Kamitani, Nagaokakyo (JP); Yoko Kaneda, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 537 days.

(21) Appl. No.: 12/959,462

(22) Filed: Dec. 3, 2010

(65) Prior Publication Data

US 2011/0070109 A1 Mar. 24, 2011

Related U.S. Application Data

(63) Continuation of application No. PCT/JP2009/059944, filed on Jun. 1, 2009.

(30) Foreign Application Priority Data

Jun. 5, 2008 (JP) ..... 2008-147548

(51) Int. Cl.
*F04B 17/00* (2006.01)
*F04B 35/04* (2006.01)

(52) U.S. Cl.
USPC ..... 417/410.2; 417/413.2

(58) Field of Classification Search
USPC ..... 417/410.2, 413.2; 361/695; 310/331
See application file for complete search history.

(56) References Cited

U.S. PATENT DOCUMENTS 3,963,380 A * 6/1976 Thomas et al. ..... 417/413.2
4,498,851 A * 2/1985 Kolm et al. ..... 417/410.2
4,595,338 A * 6/1986 Kolm et al. ..... 416/81
4,780,062 A * 10/1988 Yamada et al. ..... 417/410.2
4,923,000 A * 5/1990 Nelson ..... 165/122
5,008,582 A * 4/1991 Tanuma et al. ..... 310/332
5,921,757 A * 7/1999 Tsutsui et al. ..... 417/410.2
7,061,161 B2 * 6/2006 Scher et al. ..... 310/328
8,123,502 B2 * 2/2012 Blakey et al. ..... 417/413.1

(Continued)

FOREIGN PATENT DOCUMENTS

CN 1399070 A 2/2003
JP 58-140491 A 8/1983

(Continued)

OTHER PUBLICATIONS

Official Communication issued in International Patent Application No. PCT/JP2009/059944, mailed on Jun. 30, 2009.

*Primary Examiner* — Devon Kramer
*Assistant Examiner* — Amene Bayou
(74) *Attorney, Agent, or Firm* — Keating & Bennett, LLP

(57) ABSTRACT

A piezoelectric microblower includes a vibrating plate including a piezoelectric element and arranged to be driven in a bending mode by applying a voltage of a predetermined frequency to the piezoelectric element, and a blower body arranged to fix both ends or a periphery of the vibrating plate and to define a blower chamber between the blower body and the vibrating plate, an opening being provided in a portion of the blower body facing a central portion of the vibrating plate. In a portion of the blower chamber corresponding to the central portion of the vibrating plate, a partition is provided around the opening and a resonance space is defined inside of the partition. A size of the resonance space is set such that a driving frequency of the vibrating plate and a Helmholtz resonance frequency of the resonance space correspond to each other.

14 Claims, 5 Drawing Sheets

(56) References Cited

U.S. PATENT DOCUMENTS

| | | | | |
|---|---|---|---|---|
| 2005/0074662 | A1* | 4/2005 | Cho et al. | 429/38 |
| 2007/0090726 | A1* | 4/2007 | Morris et al. | 310/330 |
| 2007/0261910 | A1 | 11/2007 | Kasai et al. | |
| 2009/0232682 | A1 | 9/2009 | Hirata et al. | |

FOREIGN PATENT DOCUMENTS

| | | | |
|---|---|---|---|
| JP | 7-27056 | A | 1/1995 |
| JP | 2004-332705 | A | 11/2004 |
| JP | 2006-157863 | A | 6/2006 |
| JP | 2006-522896 | A | 10/2006 |
| JP | 2007-527618 | A | 9/2007 |
| JP | 2008-14148 | A | 1/2008 |
| WO | 2004/090335 | A1 | 10/2004 |
| WO | 2005/008348 | A2 | 1/2005 |
| WO | WO 2006111775 | A1 * | 10/2006 |
| WO | 2008/069266 | A | 6/2008 |

* cited by examiner

PIEZOELECTRIC MICROBLOWER

BACKGROUND OF THE INVENTION

1. Field of the Invention

The present invention relates to piezoelectric microblowers used to transport a compressible fluid, such as air.

2. Description of the Related Art

The generation of heat inside compact electronic devices, such as notebook computers and digital AV devices, for example, is a significant problem. It is important and necessary that cooling blowers used in such devices are compact, have a low profile, and have low power consumption.

Driving units that are used in cooling blowers include a diaphragm that is bent and deformed by a piezoelectric member. Generally, a vibrating plate is provided as a diaphragm that is made of a thin resin or metal plate to which a piezoelectric element is attached. Advantageously, this structure has a low profile and low power consumption. Airflow is generated by applying an alternating voltage to the piezoelectric element so as to cause bending deformation, whereby the pressure in a blower chamber is changed. In this kind of piezoelectric microblower, there has been a problem in that if the size of the vibrating plate is reduced so as to reduce the size of the blower, the displacement is significantly reduced, whereby the flow rate is reduced and the desired cooling effect cannot be obtained. Therefore, it has not been possible to sufficiently reduce the size of such blowers.

In Japanese Unexamined Patent Application Publication No. 2008-14148, a jet-flow-generating apparatus is disclosed that includes a casing, a vibrating actuator, and a nozzle member. The vibrating actuator includes a magnet, a vibrating plate on which a driving coil is mounted, an elastic support member that supports the vibrating plate, and a yoke. Where the characteristic frequency of the vibrating plate inside the casing satisfies the conditions for Helmholtz resonance in the casing, the noise is increased. Therefore, the characteristic frequency of the vibrating plate is set so as to be different from the Helmholtz resonant frequency of the casing. Specifically, for a Helmholtz resonant frequency of the casing of 1.09 kHz and a characteristic frequency of the vibrating plate of around 1 kHz, the material of the vibrating plate is changed or a rim or a portion at which the thickness partially changes is provided in the vibrating plate to change the rigidity of the vibrating plate, whereby the characteristic frequency of the vibrating plate is changed to 1.4 kHz to 2.4 kHz. However, if the resonant frequency of the casing is 1.09 kHz and the cavity volume is $1.5\times10^{-5}$ $m^3$, for example, the casing has approximate dimensions of 100 mm×30 mm×5 mm and cannot be used for very compact mobile appliances. Furthermore, at a driving frequency of 1 kHz, since it is within the audible range, noise becomes a problem.

In Japanese Unexamined Patent Application Publication No. 2008-14148, in order to reduce noise, the resonant frequency of the air inside the blower chamber is set to be different from the resonant frequency of the vibrating plate, because the resonant frequency is within the audible range. When the vibrating plate is driven at a frequency outside of the audible range, noise is no longer a problem.

Accordingly, in a gas-flow generator described in Japanese Unexamined Patent Application Publication No. 2006-522896, an ultrasonic driver is provided which includes a stainless steel disk having a larger diameter than a piezoelectric material disk that is sandwiched between the piezoelectric material disk and a diaphragm (stainless steel membrane) (see FIG. 1 and paragraph 0018 of Japanese Unexamined Patent Application Publication No. 2006-522896). Since ultrasonic driving is performed in a region outside of the audible range by using the third-order resonance mode of piezoelectric bending vibration, the problem of noise does not arise. Driving performed in the first-order resonance mode is preferable since the maximum displacement is obtained. However, first-order resonant frequencies may be within the audible range and, thus, noise is a problem. In contrast, in the third-order resonance mode, the amount of displacement is smaller but, since the frequency is outside of the audible range, noise is not a problem. However, if the diameter of the diaphragm is reduced to attempt to reduce the size of the blower, since the displacement is significantly reduced, the characteristics of the blower are deteriorated and the desired cooling effect is not obtained.

SUMMARY OF THE INVENTION

To overcome the problems described above, preferred embodiments of the present invention provide a piezoelectric microblower that can be of reduced size while still obtaining good blower characteristics.

A preferred embodiment of the present invention provides a piezoelectric microblower including a vibrating plate arranged to be driven in a bending mode by applying a voltage having a predetermined frequency to a piezoelectric element, a blower body that is fixed to both ends or a periphery of the vibrating plate and defines a blower chamber between the blower body and the vibrating plate, and an opening provided in a portion of the blower body facing a central portion of the vibrating plate. In a portion of the blower chamber corresponding to the central portion of the vibrating plate, a partition is provided around the opening and thereby a resonance space is provided inside of the partition and a size of the resonance space is set such that the driving frequency of the vibrating plate and the Helmholtz resonance frequency of the resonance space correspond to each other.

The resonant frequency of the blower chamber is preferably set to match the driving frequency of the vibrating plate, whereby the performance of the blower can be improved by utilizing the resonance of air in the blower chamber. However, when attempting to cause resonance of air in the entire blower chamber at a frequency beyond the audible range (for example 20 kHz or above), the dimensions of the vibrating plate defining one surface of the blower chamber must be reduced, and therefore, the displacement is decreased and the flow rate is significantly reduced. That is, when it is attempted to cause resonance in the blower chamber in order to increase the flow rate, it is necessary to reduce the size of the vibrating plate as described above, and in fact, the flow rate is actually reduced. Accordingly, in a preferred embodiment of the present invention, a resonance space is defined by providing a partition within the blower chamber and this resonance space has dimensions that are less than those of the vibrating region of the vibrating plate, whereby Helmholtz resonance is generated in the resonance space and the size of the vibrating region of the vibrating plate is maintained. In this manner, the region that effectively acts as the resonance chamber due to the partition, is appropriately set and adjusted to the target Helmholtz resonant frequency independently of the dimensions of the blower chamber, and therefore, a microblower having a high flow rate is provided by utilizing the resonance of air. Further, independently of the dimensions of the blower chamber, the vibrating plate can also be appropriately designed within the range of choices of component parameters (i.e., thickness, size, Young's modulus, etc.) so as to achieve the target driving frequency. Thus, a microblower is obtained that is compact and has a high flow rate. Furthermore, since the vibrating plate can be driven in a range beyond the audible range, the problem of noise is also overcome.

A gap is preferably provided between the partition and a portion of the vibrating plate or the blower body facing the partition, such that there is no contact therebetween when the vibrating plate is displaced. In this case, the periphery of the resonance space is not completely closed, and the resonance space communicates with the surrounding blower chamber via the minute gap, Moreover, where the portion of the vibrating plate that faces the partition is a node point of vibration of the vibrating plate or where the partition is made of a soft material, such as rubber, for example, even if the partition and the vibrating plate contact each other, the same effect as described above is obtained.

According to a preferred embodiment of the present invention, the minute gap, which is provided between the partition and the vibrating plate or the blower body facing the partition, is preferably smaller than the diameter of the opening. If the gap between the partition and the opposing wall is too small, the partition and the portion facing the partition (vibrating plate or blower body) come into contact with each other when the vibrating plate is displaced. Since this would inhibit vibration of the vibrating plate, such contact is not preferable. However, making the gap too large is equivalent to actually enlarging the resonance space, and therefore, the resonant frequency would be changed and the desired resonance of air would not be obtained. Accordingly, the minute gap is preferably set to be less than the diameter of the opening and thereby a space can be provided that effectively acts as the resonance chamber.

The partition may be arranged so as to protrude from the blower body or may be arranged so as to protrude from the vibrating plate. If the partition is arranged so as to protrude from the blower body toward the vibrating plate, the partition may preferably be a step that extends from an inner peripheral edge of the blower chamber toward the inside, for example. Furthermore, the partition may preferably be a ring-shaped protrusion, for example, whose outer periphery is arranged further inward than the inner peripheral edge of the blower chamber. In the case of the step, the size of blower chamber is simply reduced and the step is arranged close to the region through which the driven peripheral edge of the vibrating plate is displaced and there is a possibility that the bending action will be suppressed by the effect of air resistance. In the case of the ring-shaped protrusion, since another space is defined outside of the ring-shaped protrusion, the effect of air resistance is reduced and better characteristics are obtained. Furthermore, ring-shaped protrusions having slightly different diameters may preferably be provided so as to respectively protrude from the blower body and the vibrating plate and the two protrusions may preferably overlap each other in the axial direction.

According to a preferred embodiment of the present invention, the vibrating plate is preferably resonantly driven in a third-order mode and the partition is preferably arranged at a location corresponding to a node point of vibration of the vibrating plate. Since the node point is at a location at which the vibrating plate is not displaced, even when the partition is located very close to the vibrating plate, the effect on the displacement is negligible. In this case, since the partition and the portion facing the partition (vibrating plate or blower body) are close to each other, the volume of the resonance space is stabilized and the desired Helmholtz resonance is generated. The partition may preferably be arranged so as to protrude from the blower body or may be arranged so as to protrude from the vibrating plate.

When the vibrating plate includes a diaphragm to which a ring-shaped piezoelectric element is attached, the inner diameter of the piezoelectric element is preferably approximately equal to or less than the inner diameter of the partition, for example. The displacement at the central portion of the diaphragm is greater with a vibrating plate that includes a ring-shaped piezoelectric element than with a vibrating plate that includes a circular plate-shaped piezoelectric element. Consequently, the flow rate can be increased by arranging the resonance space in the central portion of the diaphragm at which the displacement is greatest.

Furthermore, the vibrating plate may preferably include a ring-shaped piezoelectric element that is attached to a side of a surface of the diaphragm on the blower chamber side and the resonance space may be provided on the inner peripheral side of the piezoelectric element, for example. Particularly, the space inside of the ring-shaped piezoelectric element can be used as the resonance space. In this case, there is no need to provide a special partition. In addition, the piezoelectric element may preferably be directly attached to the diaphragm or a ring-shaped intermediate plate may be interposed between the diaphragm and the piezoelectric element.

The vibrating plate according to a preferred embodiment of the present invention may be a unimorph type vibrating plate in which a piezoelectric element that expands and contacts in a planar direction is provided on a single side of a diaphragm (resin board or metal plate), may be of a bimorph type vibrating plate in which piezoelectric elements that expand and contact in opposite directions are provided on both sides of a diaphragm, or may be of a bimorph type vibrating plate in which a multilayer piezoelectric element that bendingly deforms is provided on a single side of a diaphragm, or furthermore the diaphragm itself may be defined by a multilayer piezoelectric element, for example. In addition, the piezoelectric element may have a circular-plate shape or a ring shape, for example. The vibrating plate may include an intermediate plate that is affixed between the piezoelectric element and the diaphragm, for example. In any case, it is sufficient that the vibrating plate is configured to bendingly vibrate in the plate-thickness direction as a result of application of an alternating voltage (alternating current voltage or square-shaped wave voltage) to the piezoelectric element.

Although the vibrating plate does not necessarily have to be resonantly driven, it is preferable that the vibrating plate is resonantly driven. For example, it is preferable to perform driving in the first-order resonance mode (first-order resonant frequency), since a maximum amount of displacement is obtained. However, sometimes a first-order resonant frequency is within the audible range of humans and noise becomes a problem. In contrast, when the third-order resonance mode (third-order resonant frequency) is used, although the amount of displacement is decreased as compared to in the first-order resonance mode, a greater amount of displacement is obtained than in the case in which a resonance mode is not used and since driving can be performed at a frequency outside the audible range, noise is prevented. The term "first-order resonance mode" refers to a mode in which the central portion and the periphery of the vibrating plate are displaced in the same direction. The term "third-order resonance mode" refers to a mode in which the central portion and the periphery of the vibrating plate are displaced in opposite directions.

The blower body according to a preferred embodiment of the present invention preferably includes a first wall that faces the vibrating plate with the blower chamber therebetween, a first opening that is provided in a portion of the first wall that faces the central portion of the vibrating plate and allows the inside and the outside of the blower chamber to communicate with each other, a second wall that is provided on the side opposite to the blower chamber with the first wall therebetween, a second opening provided in a portion of the second wall that faces the first opening, and a central space formed between the first wall and the second wall, the outer side of which communicates with the outside and through which the first opening and the second opening communicate with each other. Furthermore, the blower body may preferably be configured such that a portion of the first wall that faces the central space vibrates together with driving of the vibrating plate, for example. That is, by setting the characteristic frequency of the portion of the first wall that faces the central space to be close to the driving frequency of the vibrating plate or to be an integer multiple or fraction of the driving frequency of the vibrating plate, the first wall can be arranged to vibrate along with the displacement of the vibrating plate. In this case, the displacement of the first wall functions to increase the flow rate of the flow of the fluid generated by the vibrating plate and a further increase in the flow rate is achieved. In addition, the characteristic frequency of the portion of the first wall that faces the central space is preferably close to the resonant frequency of the vibrating plate and the portion of the first wall facing the central space and the vibrating plate are preferably caused to resonate. Thus, a further increase in the flow rate is achieved. The vibrating plate and the first wall may vibrate in the same resonance mode or one may vibrate in the first-order resonance mode and the other may vibrate in the third-order resonance mode.

With the piezoelectric microblower according to various preferred embodiments of the present invention, since a resonance space is defined by providing a partition within a blower chamber, Helmholtz resonance is generated in the resonance space and the flow rate is thereby increased. Moreover, the size of the vibrating plate can be appropriately designed independently of the dimensions of the resonance space such that the target vibrational frequency is obtained. Thus, a compact microblower can be provided while still obtaining good blower performance.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereafter, preferred embodiments of the present invention will be described with reference to the drawings.

First Preferred Embodiment

Figure 1:
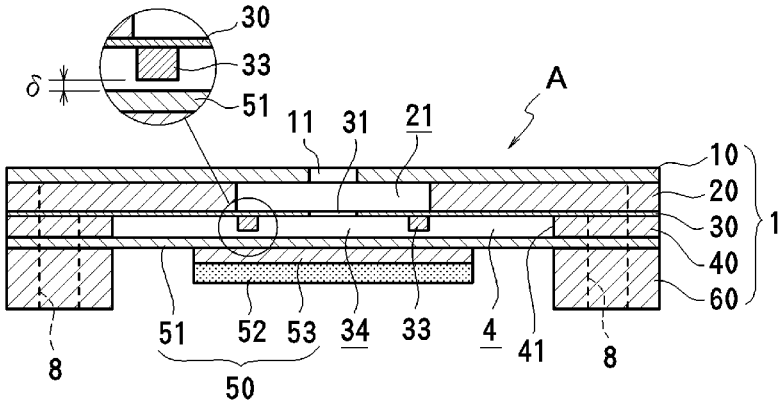
FIG. 1 is a sectional view of a piezoelectric microblower according to a first preferred embodiment of the present invention.
Figure 2:
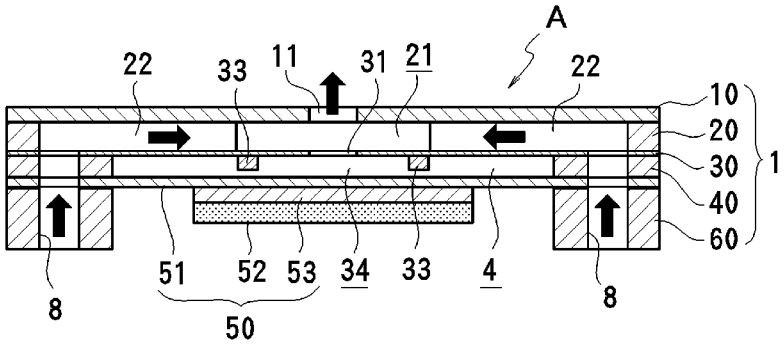
FIG. 2 is a sectional view taken along an inflow opening of the piezoelectric microblower illustrated in FIG. 1.
Figure 3:
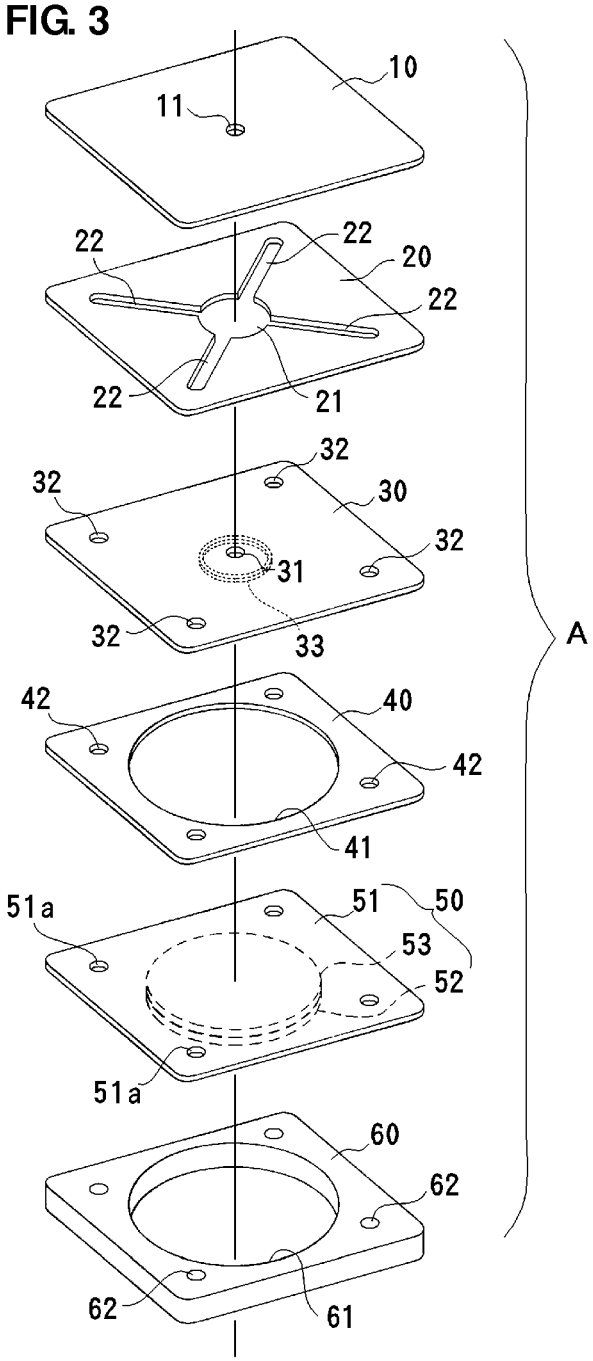
FIG. 3 is an exploded perspective view of the piezoelectric microblower illustrated in FIG. 1.

A piezoelectric microblower according to a first preferred embodiment of the present invention is illustrated in FIGS. 1 to 3. In this preferred embodiment, an example will be described in which a vibrating plate 50 is resonantly driven. A piezoelectric microblower A according to this preferred embodiment is an example of a microblower preferably used as an air-cooling blower of an electronic appliance and includes a top plate (second wall) 10, a flow-passage-forming plate 20, a separator (first wall) 30, a blower frame 40, the vibrating plate 50, and a bottom plate 60 that are stacked on top of one another in order from top to bottom and attached to one another. The outer periphery of a diaphragm 51 of the vibrating plate 50 is preferably bonded between the blower frame 40 and the bottom plate 60. The top plate 10, the flow-passage-forming plate 20, the separator 30, the blower frame 40, and the bottom plate 60 define a blower body 1 and preferably include rigid flat-plate-shaped members, such as metal plates or rigid resin boards, for example.

The top plate 10 is preferably defined by a quadrilaterally shaped flat plate and a discharge opening (second opening) 11 is arranged so as to extend therethrough in a central portion thereof. The flow-passage-forming plate 20 is also preferably a flat plate and has the same or substantially the same outer shape as the top plate 10, and as illustrated in FIG. 3, a central hole (central space) 21, which preferably has a diameter greater than that of the discharge opening 11, is provided in a central portion thereof. A plurality (here, preferably four, for example) of inflow passages 22 are arranged so as to extend in radial directions toward the four corners from the central hole 21. In the case of the piezoelectric microblower A according to this preferred embodiment, since the inflow passages 22 communicate with the central hole 21 from four directions, the fluid is drawn into the central hole 21 without resistance by the pumping action of the vibrating plate 50 and a further increase in the flow rate is obtained.

The separator 30 is also preferably a flat plate having the same or substantially the same outer shape as the top plate 10 and a through hole 31 (first opening), which has substantially the same diameter as the discharge opening 11, is provided in a central portion thereof at a location facing the discharge opening 11. In addition, the discharge opening 11 and the through hole 31 may preferably have the same diameter or may have different diameters as long as they have a diameter less than that of the central hole 21. In the vicinity of the four corners, inflow holes 32 are preferably provided at locations corresponding to the outer ends of the inflow passages 22. The discharge opening 11, the central hole 21, and the through hole 31 are arranged to be aligned on a coaxial line and correspond to a central portion of the vibrating plate 50 to be described later by attaching the top plate 10, the flow-passage-forming plate 20 and the separator 30 to one another. In addition, as will be described later, the separator 30 is preferably made of a thin metal plate, for example, since a portion of the separator 30 that corresponds to the central hole 21 will resonate. A partition 33, preferably defined by a ring-shaped protrusion, for example, is attached to a central portion of the separator 30 on the lower surface thereof so as to surround the through hole 31.

The blower frame 40 is also preferably a flat plate having the same or substantially the same outer shape as the top plate 10 and a cavity 41 having a relatively large diameter is provided in the central portion thereof. Inflow holes 42 are preferably arranged in the vicinity of the four corners at locations corresponding to the inflow holes 32. A blower chamber 4 is defined by the cavity 41 of the blower frame 40 by attaching the separator 30 and the diaphragm 51 to each other with the blower frame 40 therebetween. In the blower chamber 4, a region surrounded by the partition 33 defines a resonance space 34 and the diameter of the partition 33 is preferably set such that the resonant frequency of the vibrating plate 50 and the Helmholtz resonant frequency of the resonance space 34 correspond to each other, as will be described later. A minute gap δ is provided between the top of the partition 33 and the vibrating plate 50 such that there is no contact therebetween when the vibrating plate 50 is resonantly displaced. The gap δ is preferably less than the diameter of the through hole 31, for example.

The bottom plate 60 is also preferably a flat plate having the same or substantially the same outer shape as the top plate 10 and a cavity 61 having substantially the same shape as the blower chamber 4 is provided in the central portion thereof. The bottom plate 60 is preferably configured so as to be thicker than the sum of the thickness of a piezoelectric element 52 and the amount of displacement of the vibrating plate 50 such that even when the microblower A is mounted on a substrate or other suitable structure, the piezoelectric element 52 is prevented from contacting the substrate. The cavity 61 defines a cavity that encloses the region surrounding the piezoelectric element 52 of the diaphragm 51 as will be described later. Inflow holes 62 are preferably provided in the vicinity of the four corners of the bottom plate 60 at locations corresponding to the inflow holes 32 and 42.

The vibrating plate 50 includes a piezoelectric element 52, preferably having a circular shape, for example, that is attached to a central portion of the lower surface of the diaphragm 51 with an intermediate plate 53 therebetween. For the diaphragm 51, a variety of metal materials can be used, such as stainless steel or brass, for example, or a resin board made of a resin material, such as glass epoxy resin, for example, may be used. The piezoelectric element 52 and the intermediate plate 53 are preferably circular plates having a smaller diameter than the cavity 41 of the blower frame 40, for example. In this preferred embodiment, a single piezoelectric ceramic plate including electrodes on the top and bottom surfaces thereof is used as the piezoelectric element 52 and a unimorph diaphragm is defined by attaching the piezoelectric element 52 to the bottom surface (surface on opposite side to the blower chamber 4) of the diaphragm 51 with the intermediate plate 53 therebetween. The intermediate plate 53 is preferably an elastic plate that is similar to the diaphragm 51 and when the vibrating plate 50 bendingly deforms, the neutral plane of displacement is set so as to fall within the range of the thickness of the intermediate plate 53. Inflow holes 51*a* are provided in the vicinity of the four corners of the diaphragm 51 at locations corresponding to the inflow holes 32, 42 and 62. Inflow openings 8 in each of which one end thereof is open in the downward direction and the other end thereof communicates with the inflow passages 22 are provided by the inflow holes 32, 42, 62 and 51*a*.

Figure 4:
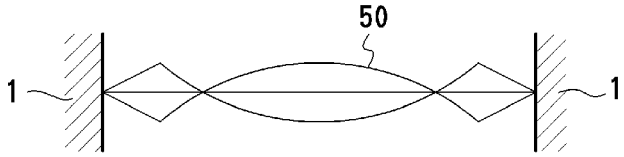
FIG. 4 illustrates displacement of a vibrating plate in the piezoelectric microblower of FIG. 1.

The vibrating plate 50 is resonantly driven in a bending mode by applying an alternating voltage (sine wave or square-shaped wave, for example) having a predetermined frequency to the piezoelectric element 52. FIG. 4 illustrates a state in which the vibrating plate 50 is resonantly driven in the third-order mode, the central portion and the peripheral portion of the vibrating plate 50 being displaced in opposite directions to each other. The partition 33 is preferably arranged in the vicinity of a node point at which the displacement is small, whereby the top of the partition 33 can be arranged as close to the vibrating plate 50 as possible. That is, the gap δ can be as small as possible and the resonant frequency of the resonance space 34 and the effect of the resonance can be ensured. In addition, the vibrating plate 50 could be resonantly driven in the first-order resonance mode. However, since the node point is located at the inner peripheral edge of the cavity 41 of the blower chamber 4 in the first-order resonance mode, the location of the partition could not be arranged at the node point. Furthermore, in contrast to in the case in which resonant driving is performed in the first-order resonance mode and there is a possibility that the first-order resonant frequency will fall within the audible range of humans, for the third-order resonance mode, since the frequency is beyond the audible range, noise is effectively prevented.

As illustrated in FIG. 1 and FIG. 2, the inflow openings 8 of the piezoelectric microblower A are open downwardly from the blower body 1 and the discharge opening 11 is open on the top surface side. Air can be sucked in from the inflow openings 8 on the bottom side of the piezoelectric microblower A and can be expelled from the discharge opening 11 on the top side, and therefore, a suitable structure is provided for an air-supplying blower of a fuel cell or an air-cooling blower of a CPU or other electronic device. Moreover, it is not necessary that the inflow openings 8 are open downwardly and they may instead be open to the outer periphery.

In FIG. 1, the vibrating plate 50 includes the intermediate plate 53 that is sandwiched between the diaphragm 51 and the piezoelectric element 52. However, a vibrating plate in which the piezoelectric element 52 is directly attached to the diaphragm 51 may be used instead.

Next, the operation of the piezoelectric microblower A having the above-described structure will be described. When an alternating voltage having a predetermined frequency is applied to the piezoelectric element 52, the vibrating plate 50 is resonantly driven in the first-order resonance mode or the third-order resonance mode and, as a result, the distance between the first opening 31 of the blower chamber 4 and the vibrating plate 50 changes. When the distance between the first opening 31 of the blower chamber 4 and the vibrating plate 50 increases, the air inside the central space 21 is sucked into the blower chamber 4 through the first opening 31, and conversely, when the distance between the first opening 31 of the blower chamber 4 and the vibrating plate 50 decreases, the air inside the blower chamber 4 is expelled into the central space 21 through the first opening 31. The vibrating plate 50 is driven at a high frequency and, therefore, a high-speed/high-energy air flow expelled from the first opening 31 into the central space 21 is expelled from the second opening 11 through the central space 21. At this time, the air in the central space 21 is expelled from the second opening 11 while being sucked in and, therefore, a continuous flow of air from the inflow passages 22 into the central space 21 is generated and the air is continuously expelled from the second opening 11 as a jet flow.

In particular, where the portion of the separator 30 that corresponds to the central space 21 is thin so as to resonate along with the resonant driving of the vibrating plate 50, since the distance between the first opening 31 and the vibrating plate 50 synchronously changes with the vibration of the vibrating plate 50, as compared to a case in which the separator 30 does not resonate, the flow rate of the air expelled from the second opening 11 is significantly increased. In addition, the separator 30 may resonate in either the first-order resonance mode or the third-order resonance mode. In this preferred embodiment, when the vibrating plate 50 is driven in the third-order mode, the separator 30 preferably vibrates in the first-order mode.

Second Preferred Embodiment

Figure 5:
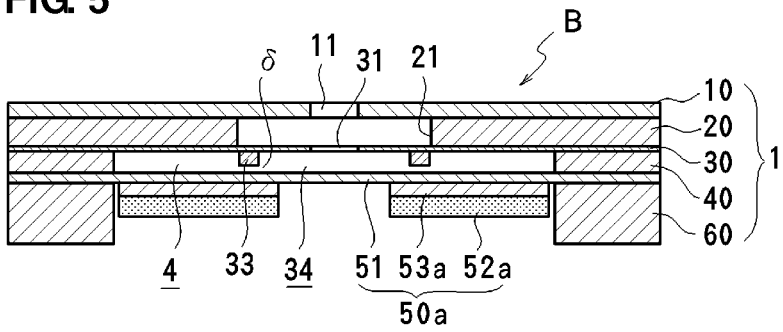
FIG. 5 is a sectional view of a piezoelectric microblower according to a second preferred embodiment of the present invention.

FIG. 5 illustrates a piezoelectric microblower according to a second preferred embodiment of the present invention. The structure of a microblower B of this preferred embodiment preferably is substantially the same as that of the piezoelectric microblower A of the first preferred embodiment, except that a ring-shaped piezoelectric element 52*a* is preferably attached to the upper surface of the diaphragm 51 with a ring-shaped intermediate plate 53*a* therebetween to define a vibrating plate 50*a*, and therefore, the same reference numerals are used and redundant description is omitted.

Figure 6:
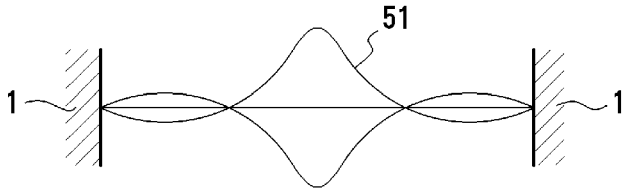
FIG. 6 illustrates displacement of a vibrating plate in the piezoelectric microblower of FIG. 5.

In this preferred embodiment, when the vibrating plate 50*a* is resonantly driven in the third-order mode, the diaphragm 51 deforms as illustrated in FIG. 6. That is, the displacement of the central portion of the diaphragm 51 is very large as compared to that at the peripheral portion. In this case, the central portion of the diaphragm 51 at which the displacement is greatest defines the resonant space 34 by setting the inner diameter of the piezoelectric element 52*a* to be approximately equal to or less than the inner diameter of the partition 33, and the flow rate is thereby increased. In addition, the amount of displacement of the central portion of the separator 30 facing the central portion of the diaphragm 51 is also large due to the amount of displacement of the central portion of the diaphragm 51 being large and a further increase in the flow rate is achieved. Furthermore, the piezoelectric element 52*a* may be directly attached to the diaphragm 51 by omitting the intermediate plate 53*a*.

Figure 7:
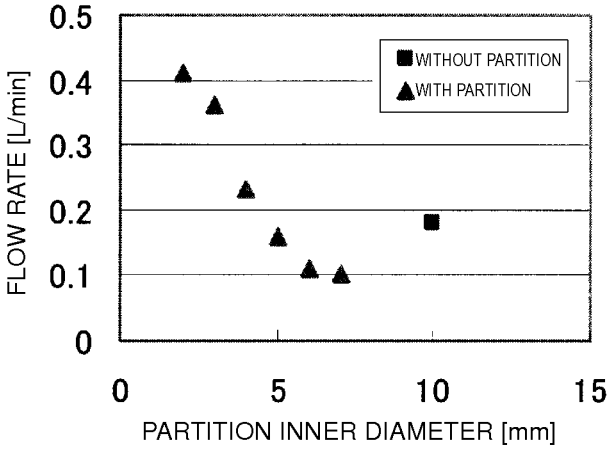
FIG. 7 is a plot of the characteristics of the flow rate when the diameter of a partition in the piezoelectric microblower illustrated in FIG. 5 is changed.

The microblower B was manufactured as described below, the diameter of the resonance space (partition) was changed and FIG. 7 illustrates an evaluation of the relationship between the diameter of the resonance space and the flow rate characteristics. A unimorph plate was prepared in which the intermediate plate, which was made of an SUS plate with a thickness of about 0.15 mm, an outer diameter of about 12 mm, and an inner diameter of about 5 mm, and the piezoelectric element, which was made of a single PZT plate with a thickness of about 0.2 mm, an outer diameter of about 12 mm, and an inner diameter of about 5 mm, were attached to the diaphragm made of a 42 Ni plate with a thickness of about 0.08 mm, for example. Then, the separator made of an SUS plate, the top plate made of an SUS plate, the flow-passage-forming plate, the blower frame, the partition and the bottom plate were prepared. Further, the second opening with a diameter of about 0.8 mm was provided in the approximate center of the top plate and the first opening having diameter of about 0.6 mm was provided in the approximate center of the separator. In addition, the central space having a diameter of about 6 mm and a height of about 0.5 mm was provided in the approximate center of the flow-passage-forming plate, for example. Then, a partition was provided such that the resonance space had a height of about 0.2 mm and an inner diameter of about 2 mm to about 7 mm, for example. Then, the above-described structural components were stacked on top of one another and attached to one another such that the microblower B having a length of about 15 mm, a width of about 15 mm and a height of about 1.5 mm, for example, was manufactured. Furthermore, for comparison, a microblower was manufactured in which a partition was not provided in the blower chamber and in which the blower chamber had an inner diameter of about 10 mm. In this experiment, driving was performed by applying a sine-wave voltage of about 26.5 kHz and about 30 Vpp to the vibrating plate. This frequency is a frequency beyond the audible range of humans.

As is clear from FIG. 7, in the range of an inner diameter of the partition (resonance space) of about 5 mm or more, as compared to the case in which no partition is provided, the flow rate of air expelled from the second opening is reduced. However, when the diameter of the partition is less than about 5 mm, the flow rate increases and the greatest flow rate is observed in the vicinity of about 2 mm. The greatest flow rate is at least two times that in the case in which no partition is provided. This is thought to be because when a resonance space in which the first opening of the separator functions as an opening is treated as a Helmholtz resonator, the resonant frequency of the resonance space at a volume in the vicinity of the point at which characteristics of the flow rate are best is close to the driving frequency of the vibrating plate, and as a result, the air in the vicinity of the first opening resonates and the air exits and enters rapidly. In this experiment, the gap δ was about 0.05 mm but there is no particular limitation on the value thereof. As long as the vibrating plate and the partition do not contact each other, the same result can be obtained for values of the gap δ of about 0.01 mm to about 0.1 mm, for example.

Third Preferred Embodiment

Figure 8:
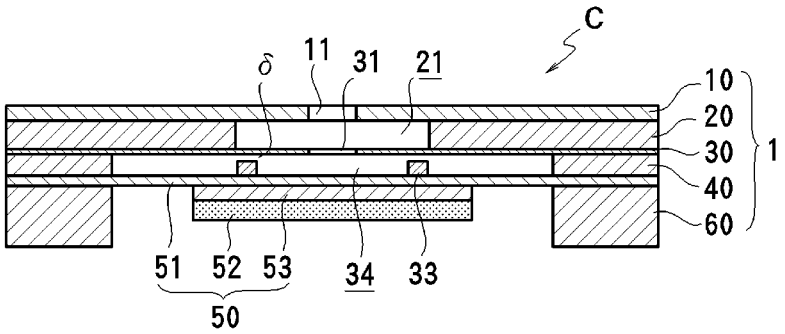
FIG. 8 is a sectional view of a piezoelectric microblower according to a third preferred embodiment of the present invention.

FIG. 8 illustrates a piezoelectric microblower according to a third preferred embodiment of the present invention. A microblower C of this preferred embodiment is substantially the same as the piezoelectric microblower A of the first preferred embodiment, except that the partition 33 is preferably fixedly attached to the top surface of the diaphragm 51. In this preferred embodiment, the partition 33 also vibrates up and down with the resonant driving of the vibrating plate 50, and therefore, it is necessary to provide a predetermined gap δ between the partition 33 and the separator 30 facing the top thereof. Provided that the location of the partition 33 is set to be in the vicinity of a node point of the vibrating plate 50, vibration of the partition 33 is reduces, which is preferable.

Fourth Preferred Embodiment

Figure 9:
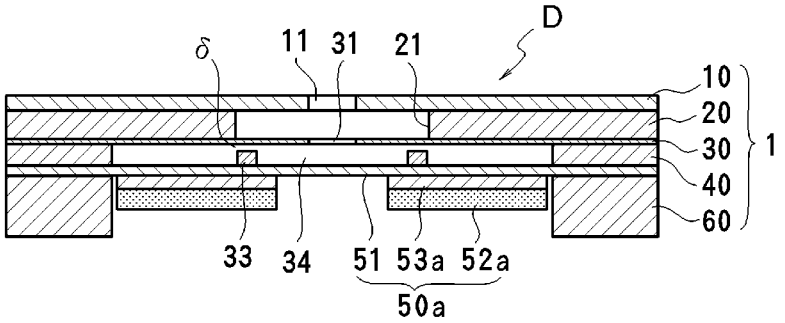
FIG. 9 is a sectional view of a piezoelectric microblower according to a fourth preferred embodiment of the present invention.

FIG. 9 illustrates a piezoelectric microblower according to a fourth preferred embodiment of the present invention. In a microblower D of this preferred embodiment, instead of the vibrating plate 50 of the piezoelectric microblower of the third preferred embodiment, the vibrating plate 50*a* preferably includes a ring-shaped piezoelectric element 52*a* and intermediate plate 53*a*, for example. In this preferred embodiment, the inner diameter of the piezoelectric element 52*a* is preferably approximately equal to or less than the inner diameter of the partition 33 and thereby the central portion of the diaphragm 51 at which the displacement is greatest defines the resonance space 34 and the flow rate is thereby increased.

Fifth Preferred Embodiment

Figure 10:
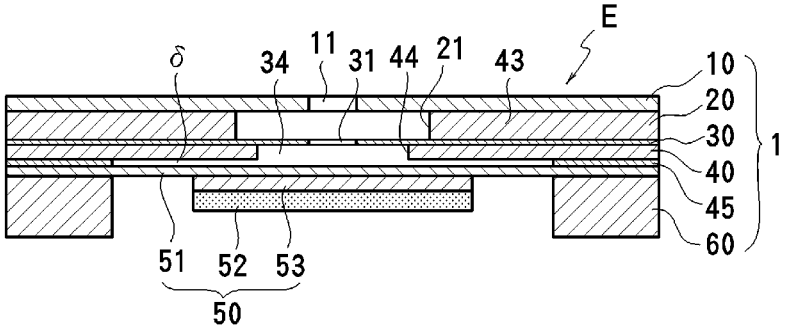
FIG. 10 is a sectional view of a piezoelectric microblower according to a fifth preferred embodiment of the present invention.

FIG. 10 illustrates a piezoelectric microblower according to a fifth preferred embodiment of the present invention and portions that are the same as those of the piezoelectric microblower A of the first preferred embodiment are denoted by the same symbols. In a microblower E of this preferred embodiment, the blower frame 40 is preferably arranged to extend toward the inner diameter side and an opening 44 is provided in the approximate center of the extended portion (partition) 43. The resonance space 34 is provided inside the opening 44. A thin spacer 45 is preferably disposed between the blower frame 40 and the diaphragm 51, and a minute gap δ is provided between the vibrating plate 50 and the extended portion 43 of the blower frame 40 by this spacer. In this preferred embodiment, the partition 43 is preferably defined by a step that extends toward the inside from the inner peripheral edge of the blower chamber. In this case, the blower chamber is substantially the same as the resonance space 34.

Sixth Preferred Embodiment

Figure 11:
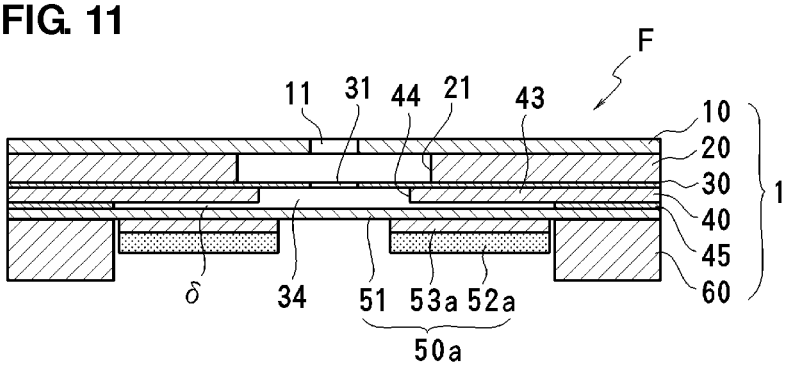
FIG. 11 is a sectional view of a piezoelectric microblower according to a sixth preferred embodiment of the present invention.

FIG. 11 illustrates a piezoelectric microblower according to a sixth preferred embodiment of the present invention. In a microblower F of this preferred embodiment, instead of the vibrating plate 50 of the piezoelectric microblower E of the fifth preferred embodiment, the vibrating plate 50*a* preferably includes a ring-shaped piezoelectric element 52*a* and intermediate plate 53*a*, for example. In this preferred embodiment, the inner diameter of the piezoelectric element 52*a* is preferably approximately equal to or less than the inner diameter of the resonance space 34 and thereby the central portion of the diaphragm 51 at which the displacement is greatest corresponds to the resonance space 34 and the flow rate is thereby increased.

Seventh Preferred Embodiment

Figure 12:
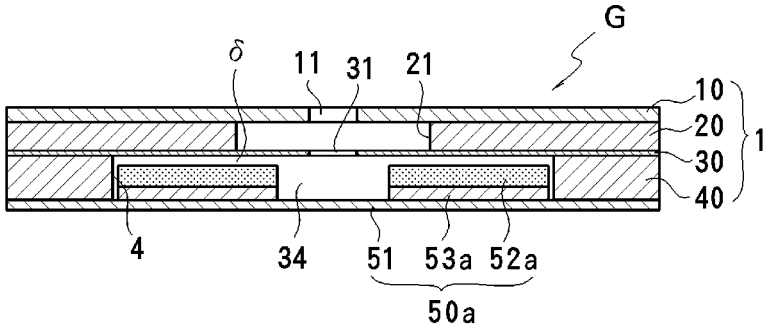
FIG. 12 is a sectional view of a piezoelectric microblower according to a seventh preferred embodiment of the present invention.

FIG. 12 illustrates a piezoelectric microblower according to a seventh preferred embodiment of the present invention. In a microblower G of this preferred embodiment, the ring-shaped piezoelectric element 52*a* and the intermediate plate 53*a* are preferably attached to the upper surface of the diaphragm 51, that is, attached to a side of a surface thereof on the blower chamber side, and the resonance space 34 is preferably provided inside of the piezoelectric element 52*a* and the intermediate plate 53*a*. A minute gap δ is provided between the piezoelectric element 52*a* and the separator 30 such that there is no contact therebetween even when the vibrating plate 50*a* is resonantly driven. In this preferred embodiment, the piezoelectric element 52*a* and the intermediate plate 53*a* are disposed inside of the blower chamber 4, and therefore, a further reduction in profile, i.e., a reduction in thickness, is achieved.

The present invention is not limited to the above-described preferred embodiments. For example, in the above description, examples were illustrated in which a separator corresponding to a central space was arranged to resonate together with the vibration of the vibrating plate. However, it is not necessarily required that a separator plate resonate. In addition, the blower body is not limited to a structure in which a plurality of plate-shaped members are stacked and attached to one another, and may instead be formed in an integrated manner from a metal or resin, for example. Furthermore, in the above-described preferred embodiments, inflow passages were provided. However, it is not necessary that inflow passages be provided. In other words, a piezoelectric microblower in which the separator (first wall) functions as the top plate of the microblower and the blower chamber is defined by the blower frame and the vibrating plate is also a suitable configuration according to a preferred embodiment of the present invention.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A piezoelectric microblower comprising:

a vibrating plate including a piezoelectric element and arranged to be driven in a bending mode by applying a voltage of a predetermined frequency to the piezoelectric element; and a blower body arranged to fix both ends or a periphery of the vibrating plate and to define a blower chamber between the blower body and the vibrating plate, an opening being provided in a portion of the blower body facing a central portion of the vibrating plate; wherein in a portion of the blower chamber spaced away from a peripheral edge of the blower chamber in a direction towards the opening and corresponding to the central portion of the vibrating plate, a partition is provided around the opening and a resonance space is defined inside of the partition;

a size of the resonance space is set such that a driving frequency of the vibrating plate and a Helmholtz resonance frequency of the resonance space correspond to each other; and the partition is arranged so as to protrude from the blower body toward the vibrating plate or from the vibrating plate toward the blower body and is defined by a ring-shaped protrusion, an outer peripheral portion of the ring-shaped protrusion being disposed closer to a center of the blower chamber than the peripheral edge of the blower chamber.

2. The piezoelectric microblower according to claim 1, wherein a gap is provided between the partition and a portion of the vibrating plate or the blower body facing the partition, such that the partition and the vibrating plate do not contact one another when the vibrating plate is displaced.

3. The piezoelectric microblower according to claim 2, wherein the gap is smaller than a diameter of the opening.

4. The piezoelectric microblower according to claim 1, wherein the vibrating plate is resonantly driven in a third-order mode and the partition is arranged at a location corresponding to a node point of vibration of the vibrating plate.

5. The piezoelectric microblower according to claim 1, wherein the piezoelectric element is ring shaped and is attached to and an inner diameter of the piezoelectric element is approximately equal to or less than an inner diameter of the partition.

6. The piezoelectric microblower according to claim 1, wherein the vibrating plate includes a ring-shaped piezoelectric element attached to a side of a surface of a diaphragm on a blower chamber side of the diaphragm, and the resonance space is disposed on an inner peripheral side of the ring-shaped piezoelectric element.

7. The piezoelectric microblower according to claim 1, wherein the blower body includes a first wall arranged to face the vibrating plate with the blower chamber therebetween, a first opening in a portion of the first wall that faces the central portion of the vibrating plate and allows an inside and an outside of the blower chamber to communicate with each other, a second wall provided on a side opposite to the blower chamber with the first wall therebetween, with a gap between the first wall and the second wall, a second opening provided in a portion of the second wall that faces the first opening, and a central space provided between the first wall and the second wall, an outer side of which communicates with the outside and through which the first opening and the second opening communicate with each other, and the blower body is arranged such that a portion of the first wall that faces the central space vibrates together with driving of the vibrating plate.

8. A piezoelectric microblower comprising:

a vibrating plate including a piezoelectric element and arranged to be driven in a bending mode by applying a voltage of a predetermined frequency to the piezoelectric element; and a blower body arranged to fix both ends or a periphery of the vibrating plate and to define a blower chamber between the blower body and the vibrating plate, an opening being provided in a portion of the blower body facing a central portion of the vibrating plate; wherein in a portion of the blower chamber spaced away from a peripheral edge of the blower chamber in a direction towards the opening and corresponding to the central portion of the vibrating plate, a partition is provided around the opening and a resonance space is defined inside of the partition;

a size of the resonance space is set such that a driving frequency of the vibrating plate and a Helmholtz resonance frequency of the resonance space correspond to each other;

the partition is defined by a step that is arranged so as to protrude from the blower body toward the vibrating plate and that extends toward a center of the blower chamber from the peripheral edge of the blower chamber; and a gap is provided between the partition and the vibrating plate.

9. The piezoelectric microblower according to claim 8, wherein the gap is arranged such that the partition and the vibrating plate do not contact one another when the vibrating plate is displaced.

10. The piezoelectric microblower according to claim 9, wherein the gap is smaller than a diameter of the opening.

11. The piezoelectric microblower according to claim 8, wherein the vibrating plate is resonantly driven in a third-order mode and the partition is arranged at a location corresponding to a node point of vibration of the vibrating plate.

12. The piezoelectric microblower according to claim 8, wherein the piezoelectric element is ring shaped and is attached to and an inner diameter of the piezoelectric element is approximately equal to or less than an inner diameter of the partition.

13. The piezoelectric microblower according to claim 8, wherein the vibrating plate includes a ring-shaped piezoelectric element attached to a side of a surface of a diaphragm on a blower chamber side of the diaphragm, and the resonance space is disposed on an inner peripheral side of the ring-shaped piezoelectric element.

14. The piezoelectric microblower according to claim 8, wherein the blower body includes a first wall arranged to face the vibrating plate with the blower chamber therebetween, a first opening in a portion of the first wall that faces the central portion of the vibrating plate and allows an inside and an outside of the blower chamber to communicate with each other, a second wall provided on a side opposite to the blower chamber with the first wall therebetween, with a gap between the first wall and the second wall, a second opening provided in a portion of the second wall that faces the first opening, and a central space provided between the first wall and the second wall, an outer side of which communicates with the outside and through which the first opening and the second opening communicate with each other, and the blower body is arranged such that a portion of the first wall that faces the central space vibrates together with driving of the vibrating plate.

* * * * *